United States Patent [19]

Korinek et al.

[11] Patent Number: 4,909,473

[45] Date of Patent: Mar. 20, 1990

[54] SHOCK ABSORBER ASSEMBLY FOR A TABLE OR THE LIKE

[75] Inventors: Chris W. Korinek, Plymouth; Robert S. Davis, Grafton, both of Wis.

[73] Assignee: Kohler Co., Kohler, Wis.

[21] Appl. No.: 287,419

[22] Filed: Dec. 20, 1988

[51] Int. Cl.[4] ..... F16M 13/00

[52] U.S. Cl. ..... 248/634; 108/136; 248/632

[58] Field of Search ..... 248/634, 632, 638, 635; 108/136; 4/646, 643, 631; 267/153, 292; 297/300

[56] References Cited

U.S. PATENT DOCUMENTS

| | | | |
|---|---|---|---|
| 1,948,193 | 2/1934 | Thompson . | |
| 2,115,653 | 4/1938 | Snyder . | |
| 2,210,097 | 8/1940 | Piron | 248/635 |
| 2,520,757 | 8/1950 | Cain | 248/362 |
| 2,779,390 | 1/1957 | Freeeman | 108/136 |
| 2,836,831 | 6/1958 | Hurwitz . | |
| 2,846,697 | 8/1958 | Phillips . | |
| 3,449,799 | 6/1969 | Bien . | |
| 3,578,278 | 5/1971 | Pickering | 108/136 X |
| 3,770,235 | 11/1973 | Klapproth | 297/300 |
| 3,784,146 | 1/1974 | Matthews | 108/136 X |
| 4,369,950 | 1/1983 | Zopf | 248/632 |

FOREIGN PATENT DOCUMENTS

| | | | |
|---|---|---|---|
| 257940 | 10/1911 | Fed. Rep. of Germany | 248/634 |
| 2335421 | 1/1975 | Fed. Rep. of Germany | 248/634 |

OTHER PUBLICATIONS

A 1987 Kohler Co. manual–"Installation Instructions–Console Tables", admitted prior art.

*Primary Examiner*—J. Franklin Foss
*Attorney, Agent, or Firm*—Quarles & Brady

[57] ABSTRACT

A shock absorber assembly for a table top is disclosed. The table top has on its bottom side a downwardly open cup recess. An insert is positioned in the recess and the insert is connectable to a table leg. A dampening filler material is positioned in the cup between the table top and insert to effectively isolate the insert (and thus, the table leg) from the table top. Breakage of highly decorative table tops is thus reduced.

7 Claims, 2 Drawing Sheets

SHOCK ABSORBER ASSEMBLY FOR A TABLE OR THE LIKE

FIELD OF THE INVENTION

This invention relates to shock absorber assemblies, and in particular to shock absorber assemblies usable with tables or the like to dampen the transmission of vibrations from table legs to table support surfaces.

BACKGROUND OF THE INVENTION

There is now a great demand for table tops which are highly decorative and distinctive. Materials such as marble and vitreous china are therefore sometimes used in bathrooms in place of more conventional counter top surface materials. While such decorative materials are strong enough to withstand most of the rigors of bathroom use, a problem has developed where table legs support such decorative surfaces. There have been instances where users have accidentally kicked the table legs with great force. The resulting vibration has been transmitted to the support surface and caused it to crack. Thus, a need exists for an improved table top/leg assembly in which motion of the table legs is not transmitted to the decorative support surface with full force.

SUMMARY OF THE INVENTION

In one embodiment, the present invention provides a shock absorber assembly for a table or the like. There is a support wall having a top and a bottom. The bottom has a downwardly open cup recess. An insert is positioned in that recess, and the insert has a means for attachment to a support leg. A dampening filler material is positioned in the cup between the support wall and insert. The filler material assists in retaining the insert in the cup and also acts to damp the transmission of vibrations from the insert to the support wall.

The filler material is preferably a flexible plastic such as epoxy resin, and the means for attachment to the support leg is preferably a substantially vertical, downwardly open threaded bore that is formed inside the insert. The insert can be made of metal, and the cup can be formed integrally on the bottom side of a table top that is made of vitreous china. The upper portion of the insert can be surrounded by the filler material and the lower portion of the insert can extend below the bottom of the cup. If desired, the upper portion of the insert can be formed with a flange, the flange then being completely surrounded by the filler material.

The flexible filler material performs a dual function. On the one hand, it dampens vibrations from the table legs. Thus, if a user bumps against a leg, the full force of the leg motion is not transmitted to the support surface. On the other hand, the filler material also serves to retain the insert in place. Thus, no additional screws or other connections between the insert and table top are required.

The flange on the upper portion of the insert assists in this, since it permits the filler material to extend below a part of the insert. Note also that when the lower portion of the insert extends below the recess cup there is no direct contact between the table leg (or table leg bracket) and the top.

The objects of the present invention therefore include:

(a) providing a shock absorber assembly of the above kind that dampens the transmission of vibrations from support legs to a table top;

(b) providing a shock absorber assembly of the above kind that provides a secure connection between such legs and such table tops;

(c) providing a shock absorber assembly of the above kind that is simple and inexpensive to manufacture, and is easy to assemble; and (d) providing a shock absorber assembly of the above kind which permits the use of certain highly decorative materials for bathroom counter top surfaces.

The foregoing and other objects and advantages of the present invention will appear from the following description. In the description, reference will be made to the accompanying drawings to illustrate preferred embodiments of the present invention. Such embodiments do not represent the full scope of the invention. Reference should therefore be made to the claims herein for interpreting the full scope of the invention.

DESCRIPTION OF PREFERRED EMBODIMENTS

Figure 1:
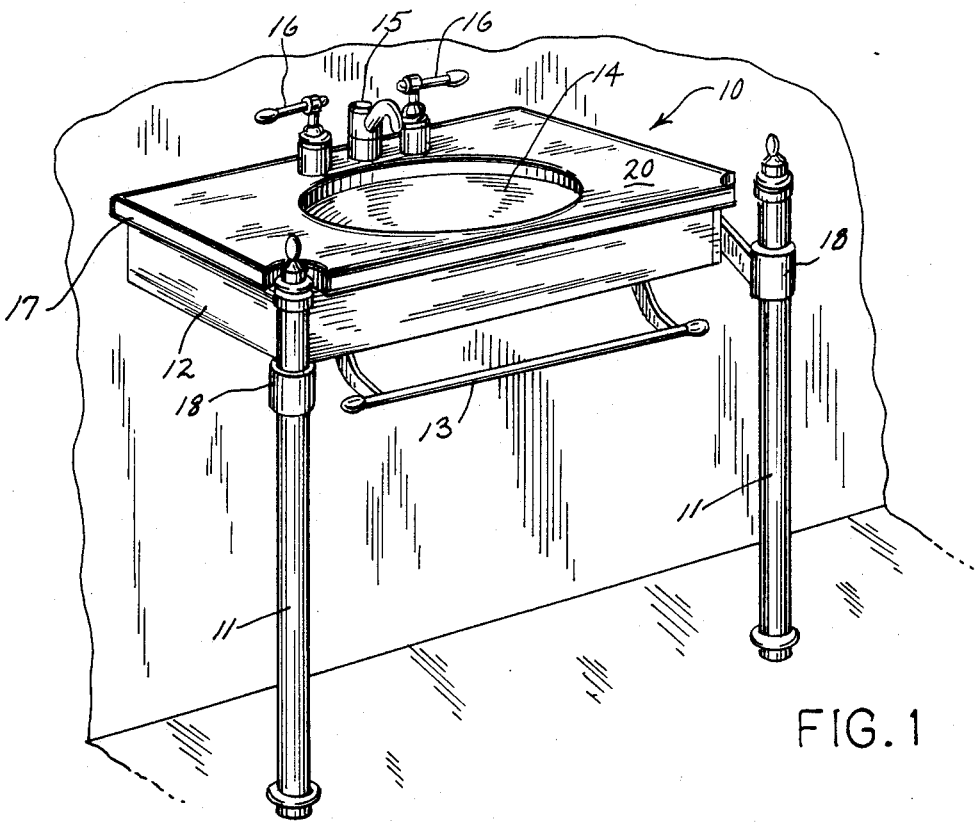
FIG. 1 is a perspective view of a console table type bathroom lavatory.

As best seen in FIG. 1, there is a console table type lavatory, generally 10. Legs 11 support the lavatory and are attached to framing 12 (or in the alternative, or in addition, to framing 19). There can also be a towel bar 13. Bowl 14 is attached by conventional means on the underside 21 of the support surface 17. Also provided are the usual spout 15 and hot/cold valves 16. Support surface 17 is preferably made of vitreous china with a decorative glaze.

Figure 2:
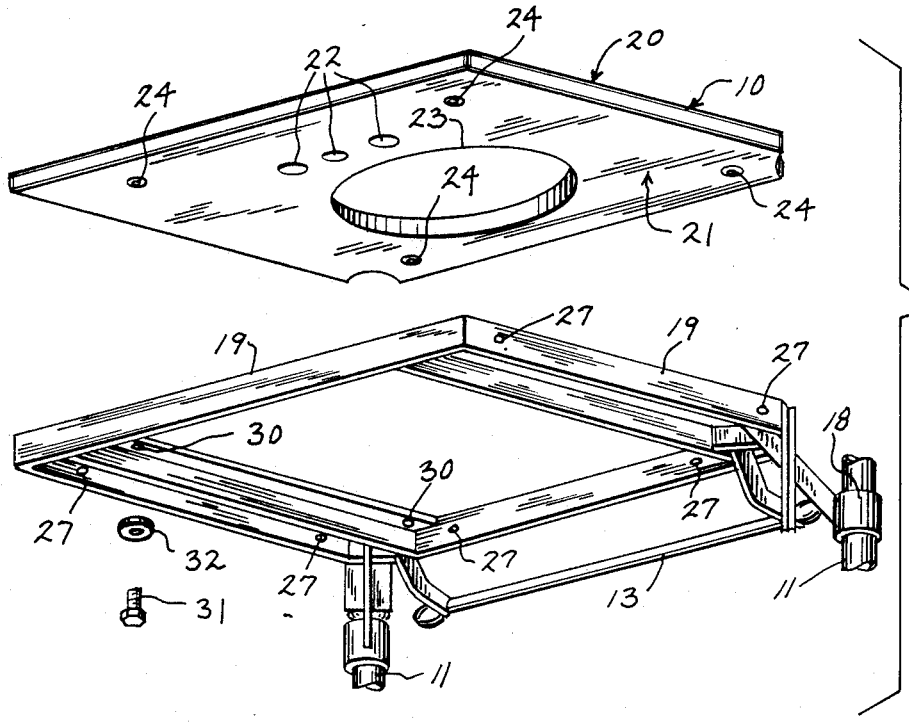
FIG. 2 is an exploded perspective view of portions thereof.

Brackets 18 are attached by screws (not shown) to legs 11, and as shown in FIG. 2 can be attached to metal framing 19. Upper decorative surface 20 has the usual fitting holes 22 and the usual central hole 23 for the sink bowl 14. Other features of interest with respect to the framing are the holes 27 (which can be used to connect framing 12 to framing 19), and four holes 30 (two are shown in FIG. 2) through which attachment bolts 31 extend. The bolts also pass through conventional washers 32.

Figure 3:
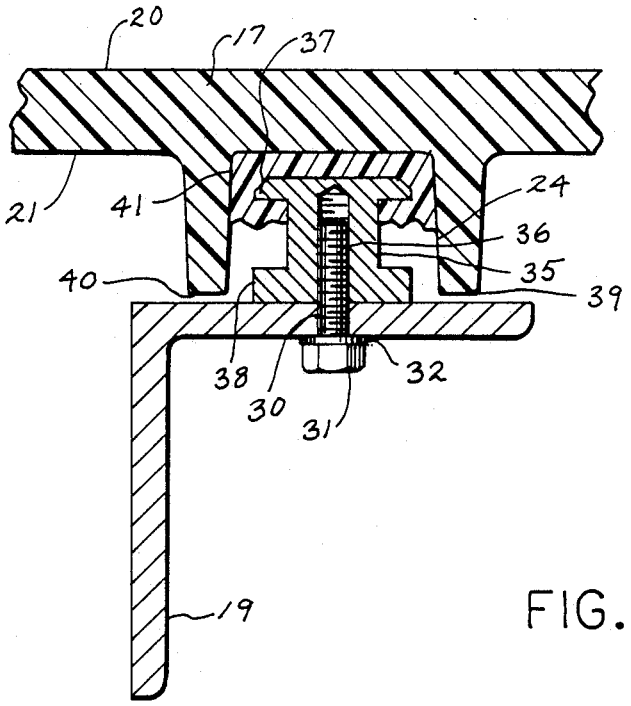
FIG. 3 is a view in vertical section of a shock absorber assembly of the present invention.

In accordance with the present invention, four cup shaped recesses 24 are integrally formed on the lower side 21 of the top 17. As best seen in FIG. 3, a metal spool-like insert 35 is positioned inside each of the cup shaped recesses. The insert has a central threaded vertical bore 36, a flange 37, and an abutment head 38. Each insert extends below the bottom 39 of the cup 24, so as to provide an abutment surface and so as to leave a gap 40 between framing member 19 and the bottom surface 39 of the cup.

An epoxy resin 41 is positioned in the cup and surrounds at least the upper portion of the metal insert. While the epoxy is shown in FIG. 3 as extending only slightly below flange 37, more could be added if desired.

If a user accidentally kicks a leg 11, the motion/vibration will be transmitted through bracket 18 to frame 19, then to metal insert 35, and then to epoxy 41. The flexible epoxy will then absorb most of the shock and not transmit it to the top 17. Note also that the epoxy serves an adhesive function in that it retains the metal insert (and, thus the frame and legs). The overall construction permits the legs to be disassembled from the table top for shipment, yet does not require the plumber to do anything complicated on site to assemble the structure.

Figure 4:
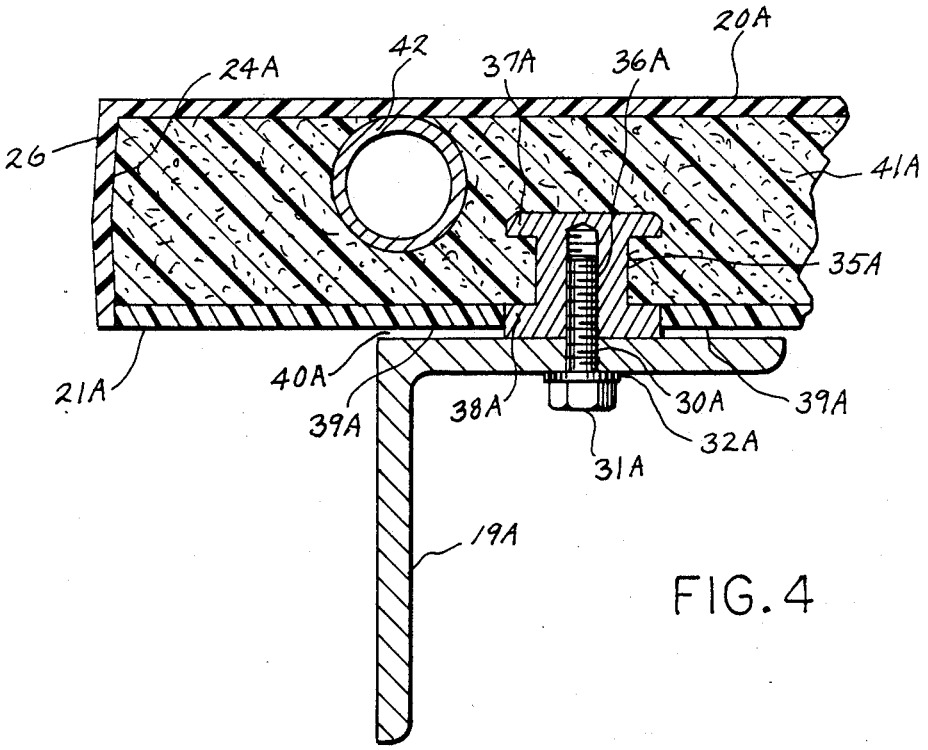
FIG. 4 is a view in vertical section, similar to that of FIG. 3, of a second embodiment of the invention.

A second embodiment is shown in FIG. 4. Parts analogous to those of the FIG. 3 embodiment are labelled with the letter A after the FIG. 3 number. In the FIG. 4 embodiment, top material 20A is a hard plastic (such as polyester) and the filler material is a plastic foam 41A. For additional support, metal pipe 42 is placed through the material. Top 20A and sides 26 of this construction form the cup 24, and thus are labelled 24A.

It will be appreciated that instead of the above construction, the dampening cup could be on part of the framing. Thus, the term "support wall" in the claim should be broadly construed. Also, while the preferred embodiments show the insert with an internal threaded bore, various other means of attachment between the insert and table legs are within the scope of the invention. For example, snap fit attachments may also work. Further, the insert can be in the form of a multi-headed bolt which threads into the framing. Further, while plastic is the preferred dampening material, other materials (such as certain rubbers) that have both adhesive and dampening properties should prove suitable for use with the invention.

Thus, it will be appreciated by those skilled in the art that modifications can be made to the preferred embodiments without departing from the invention.

We claim:

1. A shock absorber assembly for a table or the like, comprising:

a support wall having a top and a bottom, the bottom having a downwardly open cup recess;

an insert positioned in the recess, the insert having means for attachment to a support leg;

a dampening filler material positioned in the cup between the support wall and insert which assists in retaining the insert in the cup and which also acts to dampen the transmission of vibrations from the insert to the support wall;

wherein the filler material is a flexible plastic material; and wherein the upper portion of the insert is formed with a flange, the flange being surrounded by the filler material.

2. The assembly of claim 1, wherein the filler material is an epoxy resin.

3. The assembly of claim 2, wherein the means for attachment is a substantially vertical, downwardly open threaded bore formed in the insert.

4. The assembly of claim 2, wherein the insert is made of metal.

5. The assembly of claim 1, wherein the upper portion of the insert is surrounded by the filler material and the lower portion of the insert extends below the bottom of the cup so as to form an abutment surface.

6. The assembly of claim 1, wherein the cup is integrally formed on the bottom of a table top.

7. The assembly of claim 1, wherein the dampening filler material is of a type which may be added after the flange has been positioned in the cup.

* * * * *